US007490783B2

(12) United States Patent
Mueller et al.

(10) Patent No.: US 7,490,783 B2
(45) Date of Patent: Feb. 17, 2009

(54) CLEANING SPRAY NOZZLE

(75) Inventors: John R. Mueller, Merton, WI (US); Patricia M. Mueller, Merton, WI (US)

(73) Assignee: Idea Factory, Inc., Menomonee Falls, WI (US)

( * ) Notice: Subject to any disclaimer, the term of this patent is extended or adjusted under 35 U.S.C. 154(b) by 0 days.

(21) Appl. No.: 10/511,419

(22) PCT Filed: Apr. 16, 2003

(86) PCT No.: PCT/US03/11584

§ 371 (c)(1),
(2), (4) Date: Sep. 26, 2005

(87) PCT Pub. No.: WO03/089064

PCT Pub. Date: Oct. 30, 2003

(65) Prior Publication Data

US 2006/0097076 A1 May 11, 2006

Related U.S. Application Data

(60) Provisional application No. 60/373,075, filed on Apr. 16, 2002.

(51) Int. Cl.
*B05B 7/26* (2006.01)

(52) U.S. Cl. ..... 239/315; 239/310; 239/318; 239/312; 239/526; 239/588; 239/375; 239/562; 137/268

(58) Field of Classification Search ..... 239/315, 239/310, 316, 525, 526, 527, 318, 312, 375, 239/588, 652, 414; 4/226.1, 294, 903, DIG. 10; 137/268

See application file for complete search history.

(56) References Cited

U.S. PATENT DOCUMENTS

| | | | | |
|---|---|---|---|---|
| 1,868,235 | A | | 7/1932 | Jaden |
| 1,945,701 | A | * | 2/1934 | Pearl ..... 239/312 |
| 2,301,691 | A | | 11/1942 | Ellinger et al. |
| 2,602,698 | A | | 7/1952 | Wyckoff |
| 2,619,385 | A | | 11/1952 | Simms |
| 3,128,949 | A | * | 4/1964 | Kaufman ..... 239/312 |
| 3,271,809 | A | * | 9/1966 | Morawski ..... 401/42 |
| 3,402,892 | A | | 9/1968 | Ayrial |
| 3,405,669 | A | | 10/1968 | Nimrick |
| 4,890,340 | A | | 1/1990 | Lovitt |
| 5,050,340 | A | | 9/1991 | Seifert |
| 5,109,553 | A | | 5/1992 | Kishimoto |
| 5,305,476 | A | | 4/1994 | Ohyama et al. |
| 5,332,158 | A | * | 7/1994 | Styne et al. ..... 239/310 |
| 5,881,955 | A | * | 3/1999 | Styne ..... 239/310 |

(Continued)

*Primary Examiner*—Dinh Q Nguyen
(74) *Attorney, Agent, or Firm*—Joseph S. Heino; Patrick M. Bergin

(57) ABSTRACT

A spray nozzle (10) includes a nozzle body (12) and a chemical containing cartridge (28) releasably attached to the nozzle body (12). The cartridge (28) can be adapted to be releasably secured to the nozzle body (12) at the outlet end (16), the inlet end (14), or on the nozzle body (12) itself, in order to dispense a chemical contained within the cartridge into a water stream flowing through the nozzle. The nozzle (10) also includes a dispensing mechanism utilized to control the amount of the chemical dispensed into the water stream. The dispensing mechanism can be disposed on the nozzle body (12), or directly on the cartridge (28) itself.

14 Claims, 7 Drawing Sheets

U.S. PATENT DOCUMENTS 5,906,316 A * 5/1999 Gatzemeyer et al. ..... 239/10
5,991,937 A 11/1999 Safara
6,000,626 A * 12/1999 Futo et al. ..... 239/74
6,164,496 A 12/2000 Gregory
6,618,977 B1 * 9/2003 Curro ..... 43/1
6,749,135 B2 * 6/2004 Groblebe et al. ..... 239/526

* cited by examiner

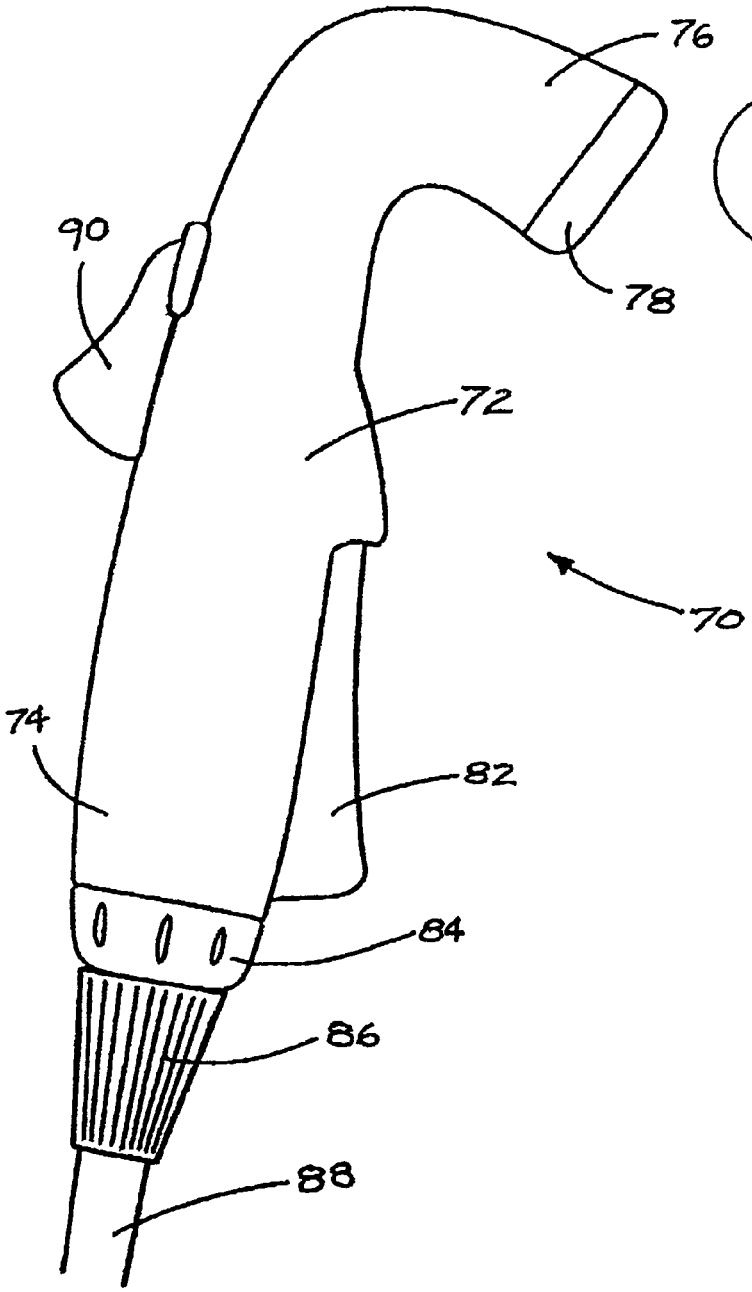
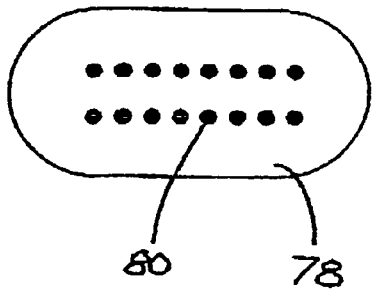
FIG 4.
FIG.3

CLEANING SPRAY NOZZLE

This application claims the benefit of U.S. Provisional Application Ser. No. 60/373,075 filed Apr. 16, 2002.

FIELD OF THE INVENTION

The present invention relates generally to cleaning nozzles. More specifically, it relates to a cleaning spray nozzle having a removably attached cartridge that selectively disperses a chemical, such as a soap, into a water stream flowing from the spray nozzle.

BACKGROUND OF THE INVENTION

In order to direct pressurized streams of water into specific locations to clean a surface or a container, spray nozzles are often utilized. These nozzles typically include a water inlet end adapted to be connected to a water source, such as a hose, and a water outlet end spaced from the inlet end and through which the pressurized stream of water is dispensed. The inlet end and outlet end are connected by a conduit within the nozzle through which the water flows.

To operate the nozzle, certain nozzles have manually depressible triggers disposed on the exterior of the trigger. When depressed, the trigger actuates a valve assembly disposed on the conduit within the nozzle that allows water entering the nozzle from the inlet to flow through the conduit and the valve assembly and out of the outlet end. The dispensing of water from the nozzle can also be controlled by a rotatable member disposed about the exterior of the outlet end of the housing, and capable of moving towards or away from a fixed portion of the housing which obstructs an opening extending through the rotatable member. Thus, by rotating the member towards or away from the housing, the member can selectively open and/or close an opening formed between the rotatable member and the housing to allow a selected amount of water to be dispensed from the nozzle.

Furthermore, regardless of the type of operating mechanism utilized for the nozzle, certain nozzles also enable a chemical, such as a soap, to be dispensed with the water flowing through the nozzle. In certain prior art nozzles, the soap is fed to the outlet end through a separate conduit such that the water and soap are intermixed only at the outlet end of the nozzle. In other prior art designs, the soap or other chemical is positioned within a cavity disposed directly within the housing. The housing is disassembled in order to expose the cavity and allow the soap to be placed within the cavity. The cavity is then closed by reassembling the housing, and water flowing through the nozzle can contact the soap contained within a cavity for dispensing the soap along with the water flowing out of the nozzle.

Some of these prior art devices also include a dispensing mechanism for selecting the volume of the water stream flowing through the nozzle that contacts the soap contained on or within the nozzle. These means normally include a rotatable valve having a passage selectively alignable with the cavity or other container containing the soap, and through which the water stream flows. By turning the valve, an individual can select the amount of incoming water which contacts the soap to select the amount of soap being dispensed with the water stream from the nozzle.

However, these prior art nozzles do not disclose a nozzle in which the container holding the soap or other chemical is adapted to be easily and removably attached to the nozzle such that the container can be replaced as necessary. Also, the number of parts needed to construct the dispensing mechanism greatly increases the cost and complexity of these spray nozzles.

As a result, it is desirable to develop a hand-operable spray nozzle which includes a soap or chemical cartridge that is releasably attachable to the nozzle. The cartridge should also be selectively contactable with the water stream flowing through the nozzle using a simplified dispensing mechanism in order to dispense soap or other chemicals into the water stream in the desired amounts.

SUMMARY OF THE INVENTION

It is an object of the present invention to provide a manually-operable spray nozzle including a soap or chemical cartridge releasably attachable to the body of the nozzle.

It is another object of the present invention to provide a nozzle in which the cartridge is generally translucent such that the amount of soap remaining within the cartridge can be easily determined and the cartridge replaced, if necessary.

It is still another object of the present invention to provide a spray nozzle in which the cartridge forms a part of the dispensing mechanism that mixes the soap within the cartridge with the outgoing water spray.

It is still a further object of the present invention to provide a spray nozzle in which the cartridge can be located at various points on the nozzle in order to accommodate various uses and/or configurations for the nozzle.

The present invention is a manually-operable spray nozzle including a nozzle body having an inlet end and an outlet end. The inlet end is selectively connected to a water source, such as a hose, and the outlet end allows the incoming water to be dispensed from the nozzle. To dispense the water, the nozzle includes an actuating member, such as a manually depressible trigger connected to a valve assembly which opens a water flow conduit extending from the inlet end to the outlet end allowing the water to exit the nozzle through the outlet end.

The nozzle also includes a detachable cartridge that is releasably attachable to the nozzle body in order to selectively dispense an amount of a chemical, such as a soap, disposed within the cartridge into the water stream flowing through the nozzle. The cartridge is preferably translucent, in order to allow an operator of a nozzle to visually determine whether the cartridge is empty of the chemical, so that the cartridge can be removed and replaced.

Further, the cartridge also includes or forms a part of a dispensing mechanism for allowing an amount of the chemical or soap contained within the cartridge, to mix with the water stream flowing through the nozzle. More specifically, the cartridge can be rotatably attached to the nozzle such that the rotation of the cartridge selects the amount of soap or chemicals to be dispensed from the cartridge into the water stream. Alternatively, the cartridge can be inserted into an opening in the nozzle body and twisted to a predetermined position in which a portion of the incoming water stream flows into contact with the cartridge to dispense an amount of the chemical into the water stream. The various objects and advantages of the present invention will be made apparent from the following detailed description taken together with the drawings.

BRIEF DESCRIPTION OF THE DRAWINGS

FIG. 3 is a left side elevational view of a third embodiment of a spray nozzle constructed according to the present invention and showing a cartridge releasably and rotatably attached to the inlet end of a nozzle.

FIG. 4 is a front elevational view of a cover plate of the nozzle illustrated in FIG. 3.

DETAILED DESCRIPTION OF THE INVENTION

Figure 1:
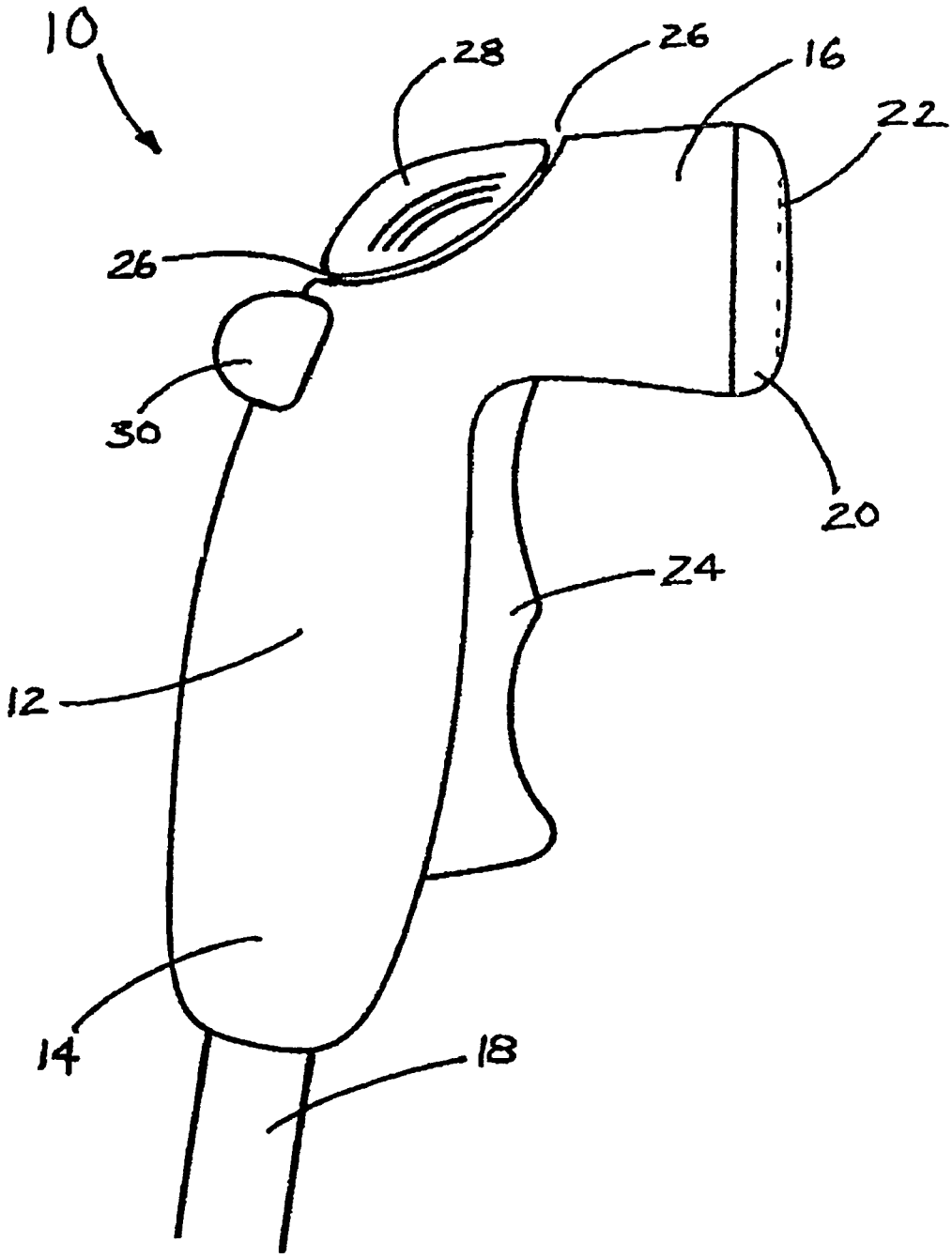
FIG. 1 is a left side elevational view of a spray nozzle constructed according to the present invention and showing a cartridge or container releasably attached to the body of the nozzle.

Referring now to the drawings in detail wherein-like numbers represent like elements throughout, FIG. 1 illustrates the first preferred embodiment of a spray nozzle, generally identified 10, constructed in accordance with the present invention. The spray nozzle 10 is formed of a body 12 including an inlet end 14 and an outlet end 16 disposed at opposite ends of the body 12. The inlet end 14 is connected to a water supply hose 18 that can be releasably connected to a water supply, such as a faucet or other similar water dispensing device. The outlet end 16 includes a cover plate 20 in which are disposed a plurality of orifices 22 that serve to direct water flowing through the orifices 22 in a predetermined spray pattern. A water conduit (not shown) extends within the body 12 from the inlet end 14 to the outlet end 16 and directs the water though the body 12.

Between the inlet end 14 and outlet end 16, the body 12 includes a manually-operable trigger 24 that is pivotally or slidably mounted to the body 12. The trigger 24 serves to operate a water valve assembly (not shown) disposed within the body 12 in engagement with the water conduit that can selectively restrict the water flow through the body 12 from the inlet end 14 to the outlet end 16. Thus, when the trigger 24 is depressed towards the body 12, water is allowed to flow through the nozzle 10. When the trigger 24 is released, such that the trigger is extended from the body 12, the valve assembly closes and prevents the flow of water through the body 12.

The body 12 also includes a recess 26 disposed between the inlet end 14 and outlet end 16 that includes an opening (not shown) extending into the body and adapted to receive a connection end (not shown) of a cartridge 28. The cartridge 28 is formed as a hollow container and shaped to conform to the overall shape of the body 12. The connection end extends outwardly from the cartridge 28 and is formed as a sleeve through which the cartridge 28 can dispense a chemical (not shown). The chemical can be in a liquid, solid, granular or other form and can be any suitable cleaning chemical, e.g., soap, cleaner or like agent or reactant. The connection end of the cartridge 28 extends through the opening to a point where the opening intersects a portion of the water flow conduit. Thus, the chemical or soap contained within the cartridge 28 can be siphoned from the cartridge 28 due to the flow of water past the connection end in order to dispense the chemical into the water flow through the nozzle 10. To ensure that the cartridge 28 is secured affixed to the body 12 within the opening, the connection end includes a securing structure, such as an end tab, a threaded portion, snap, or similar structure adapted to enable the cartridge 28 to be fixedly held to the body 12 and dispense the chemical into the water conduit.

In order to control the amount of chemical dispensed from the cartridge 28 into the water stream, the spray nozzle 10 also includes a mixing valve assembly (not shown) disposed within the body 12 adjacent the first water assembly. The mixing valve assembly is operably connected to a handle 30 disposed on the exterior of the body 12. The handle 30 is manually operable to selectively direct some or all of the incoming water flow past the connection end of the cartridge 28, such as through a parallel and separate flow conduit within the body 12, in order to dispense the chemical from the cartridge 28. Thus, the handle 30 can be used to operate the spray nozzle 10 in a mode where the water flow through the body 12 does not contain any of the chemical, or in a manner where the water stream contains a maximum amount of the chemical, or any variation in between.

The various components of the spray nozzle 10 and the cartridge 28 are preferably formed of a plastic material, and preferably a blow molded plastic material, in order to prevent any corrosion of the nozzle parts due to the water flowing through the nozzle 10. However, the nozzle 10 and its constituent parts, and the cartridge 28 can also be formed of other suitable materials.

Figure 2:
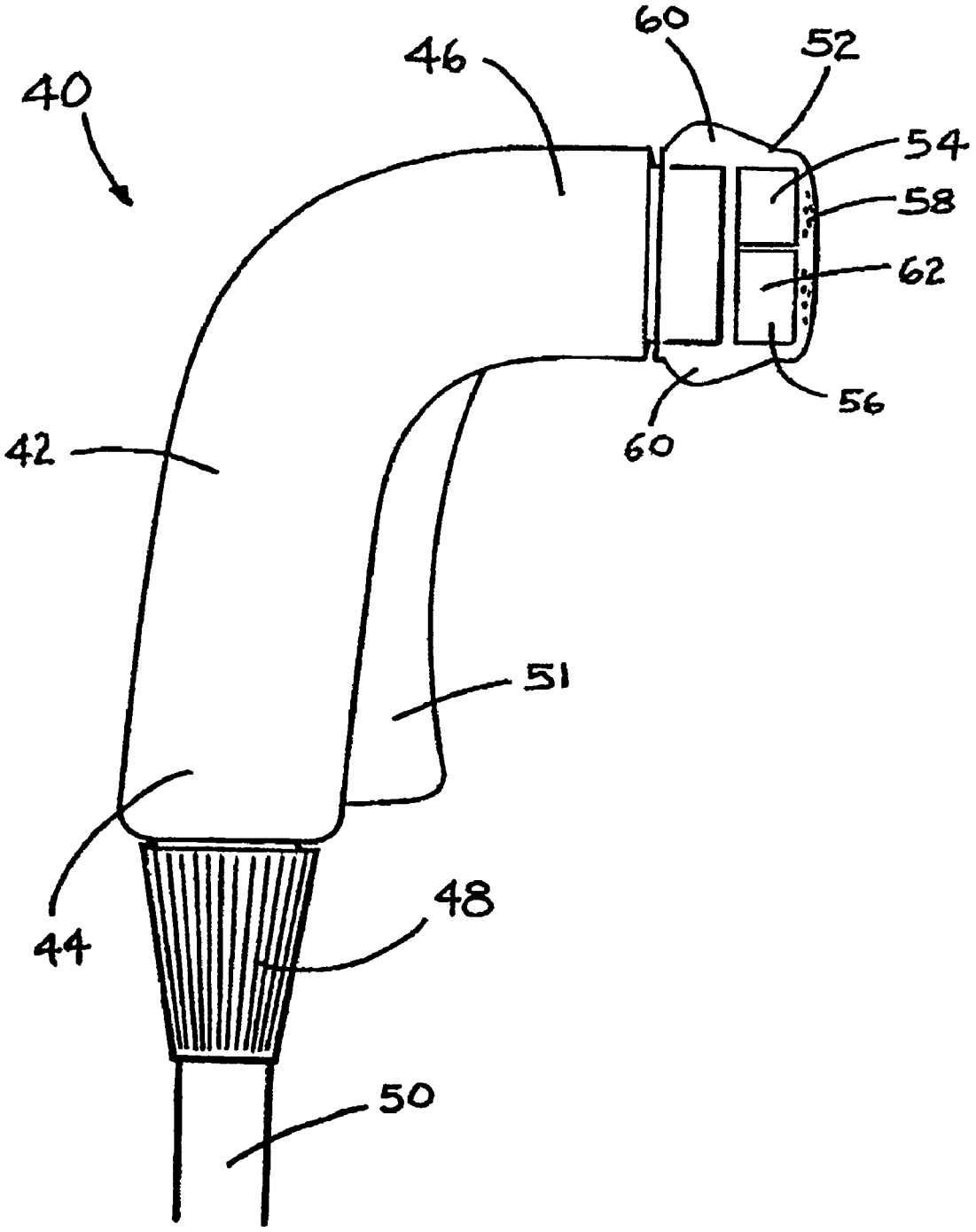
FIG. 2 is a left side elevational view of a second embodiment of the spray nozzle of the present invention and showing a cartridge releasably and rotatably attached to the outlet end of the nozzle.

Referring now to FIG. 2, a second embodiment of a spray nozzle, generally identified 40, is shown. The nozzle 40 is shaped similarly to the first nozzle 10 embodiment and includes a body 42, an inlet end 44, and an outlet end 46. The inlet end 44 is releasably connectable to a hose clamp 48 that is secured to one end of a hose 50. The hose clamp 48 is preferably threadedly engaged with the inlet end 44 in order to releasably connect the hose 50 to the spray nozzle 40. Also, in order to operate the nozzle 40, the body 42 includes a trigger 51 pivotally attached to the body 42 and operable to selectively operate a water valve assembly (not shown) disposed within the body 42 to control the flow of water through a water conduit (not shown) extending between the opposite ends of the body 42.

In the second embodiment, the outlet end 46 includes a threaded portion (not shown) disposed opposite the body 42 and adapted to releasably receive a cartridge 52. The cartridge 52 is divided into a clean water portion 54 and a soap dispensing portion 56 that each communicate with a number of orifices 58 located on the cartridge 52 opposite the outlet end 46. The cartridge 52 is threadedly engaged with the threaded end by placing the cartridge 52 against the threaded end and rotating the cartridge 52 utilizing a number of tabs 60 extending radially outwardly from the cartridge 52. Once the cartridge 52 is engaged with the body 42, the trigger 51 can be depressed to allow water to flow through the body 42 and out of the cartridge 52.

The soap dispensing portion 56 includes a selectively closable chamber 62 in which an amount of a chemical, such as soap pellets, can be disposed. To dispense the soap through the aligned orifices 58, the cartridge 52 is rotated with respect to the body 42 to align the chamber 62 with the water conduit end disposed within the outlet end 46. Water then flows from the outlet end 46 through the chamber 62, contacting and dispensing the soap disposed within the chamber 62 through the orifices 58.

Referring now to FIGS. 3 and 4, a third embodiment of a spray nozzle, generally identified 70, is illustrated. The nozzle 70 includes a body 72 having an inlet end 74 and an outlet end 76 disposed at opposite ends of the body 72 and connected by a water conduit (not shown). The outlet end 76 includes a cover plate 78 including two spaced pairs of rows of orifices 80 through which the water flowing through the nozzle 70 can be dispensed. The body 72 also includes a trigger 82 pivotally secured to the body 72 and usable to operate a water valve assembly (not shown) connected to the water conduit in the manner described above with regard to the previous embodiments.

The inlet end 74 is releasably attachable to a cartridge 84 that retains an amount of a chemical, such as soap, for dispensing with the water through one or more of the orifices 80. The cartridge 84 is preferably threadedly engaged with the inlet end 74 and with a hose clamp 86 attached to the cartridge 84 opposite the inlet end 74. The clamp 86 is attached to a hose 88 opposite the cartridge 84 in order to supply water to the nozzle 70. The chemical contained within the cartridge 84 is connected via a chemical conduit (not shown) to a switch assembly 90 disposed on the body 72 and spaced from the inlet end 74. The switch assembly 90 enables an individual utilizing the nozzle 72 to selectively dispense an amount of the chemical from the cartridge 84 into the water flow through the nozzle 70 by diverting some or all of the incoming water flow into contact with the chemical conduit.

Figure 5:
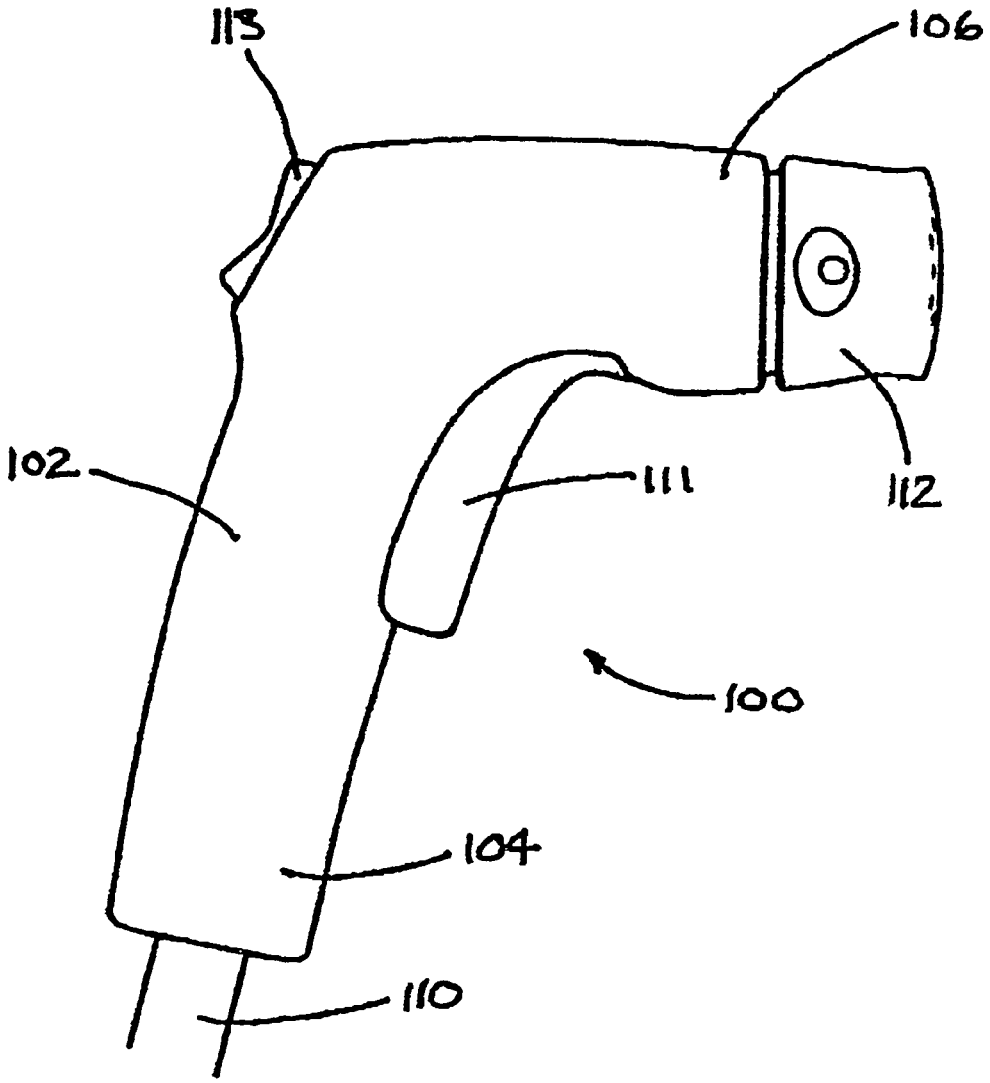
FIG. 5 is a left side elevational view of a fourth embodiment of a spray nozzle constructed in accordance with the present invention.
Figure 6:
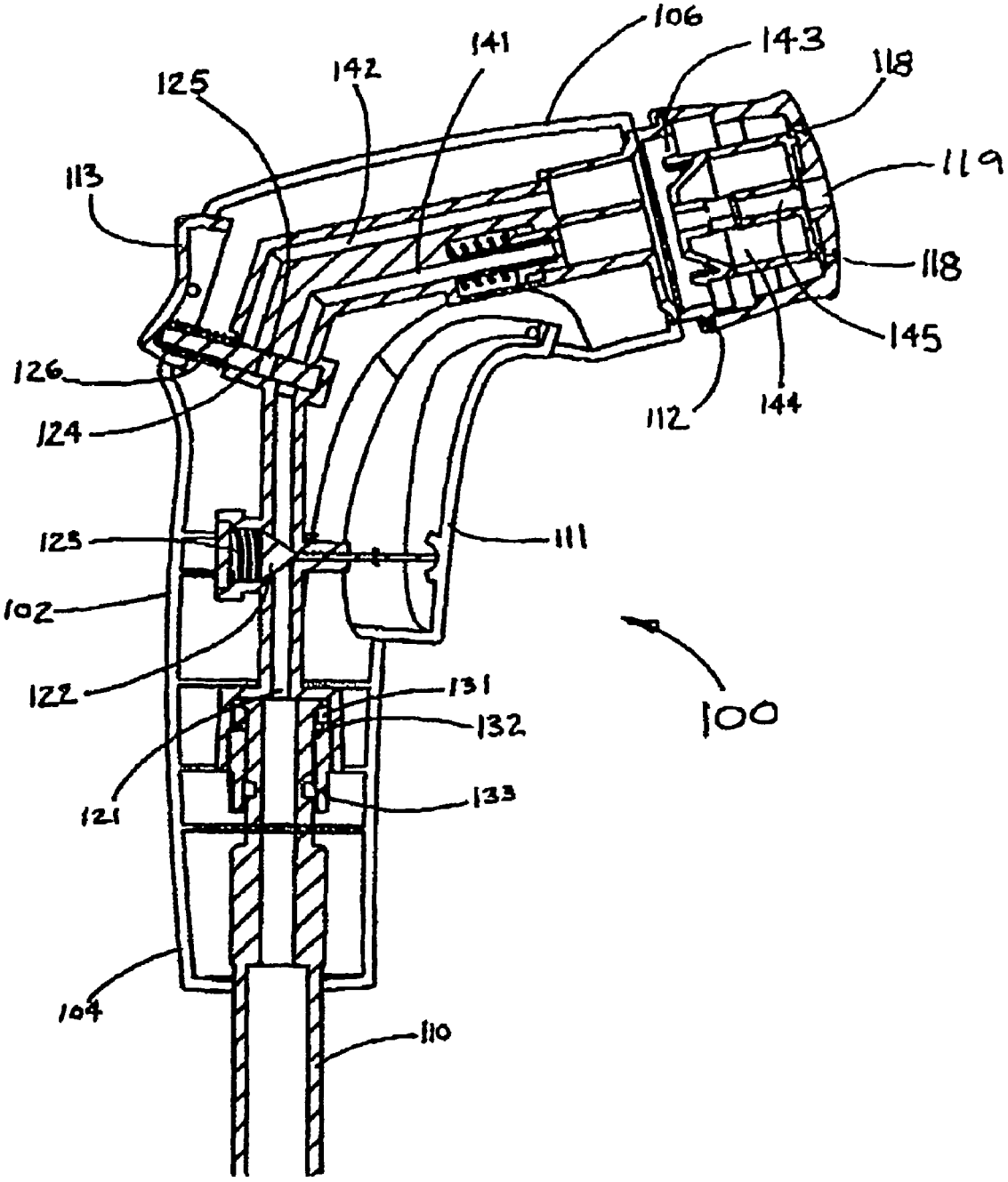
FIG. 6 is a cross sectioned left side elevational view of the spray nozzle shown in FIG. 5 and illustrating one embodiment of the inner workings of the nozzle.

Referring now to FIGS. 5 and 6, a fourth embodiment of the spray nozzle, generally identified 100, is illustrated. As shown, the spray nozzle 100 is shaped similarly to the second spray nozzle 10 embodiment and includes a body 102, an inlet end 104, and an outlet end 106. The inlet end 104 is connectable to one end of a hose 110. As shown in FIG. 6, the inlet end 104 of this nozzle body 102 embodiment includes a gasket 131 and a washer 132 to sustain water pressure and water flow through a rotational cuff 133. In order to operate the nozzle 100, the body 102 includes a trigger 111 that is pivotally attached to the body 102 and is operable to selectively operate a water valve 122 and trigger valve spring 123. The trigger valve 122 is disposed within the body 102 to control the flow of water through a water conduit 121 extending between the opposite ends of the nozzle body 102. The nozzle body 102 also includes a toggle 113 for actuation of a chemical dispensing mechanism within the nozzle body 102. The toggle 113 is functionally adapted to move a toggle valve 124 within the nozzle body 102, the toggle valve 124 being biased in one direction by means of a toggle spring 126. The toggle valve 124 includes an aperture 125 defined within it. This toggle valve aperture 125 creates a water flow continuum through the water channel 121 contained within the nozzle body 102 and a secondary clean water channel 142 defined within the nozzle body 102 as well. The toggle valve 124 also includes a secondary aperture (not shown) which is disposed to one side of the first aperture 125 and which provides a similar water flow continuum through the water channel 121 and the secondary chemical flow channel 141 defined within the nozzle body 102.

Figure 7:
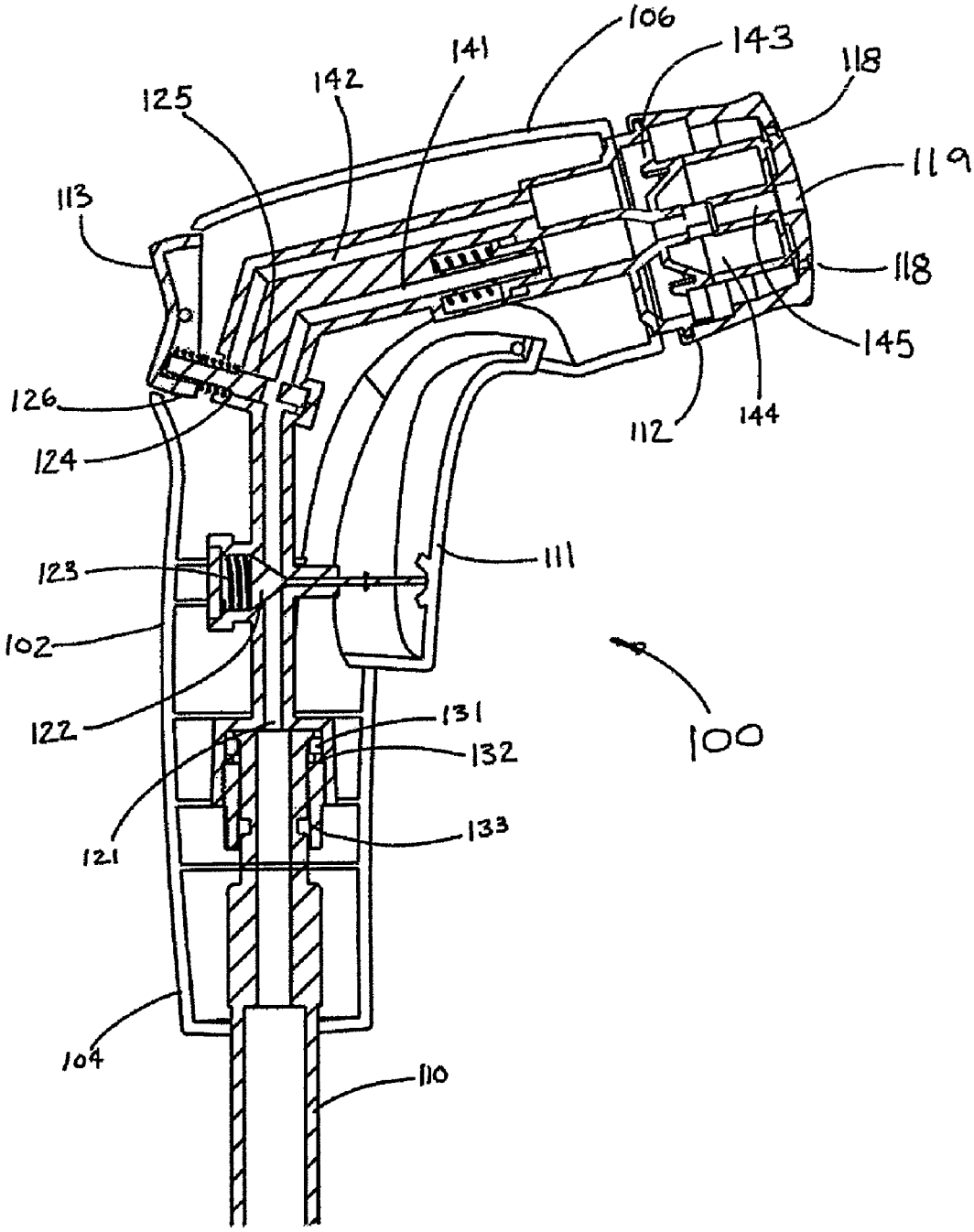
FIG. 7 is a cross sectioned side elevational view of the spray nozzle shown in FIG. 6 showing the toggle valve in the water and chemical dispensing position.
Figure 8:
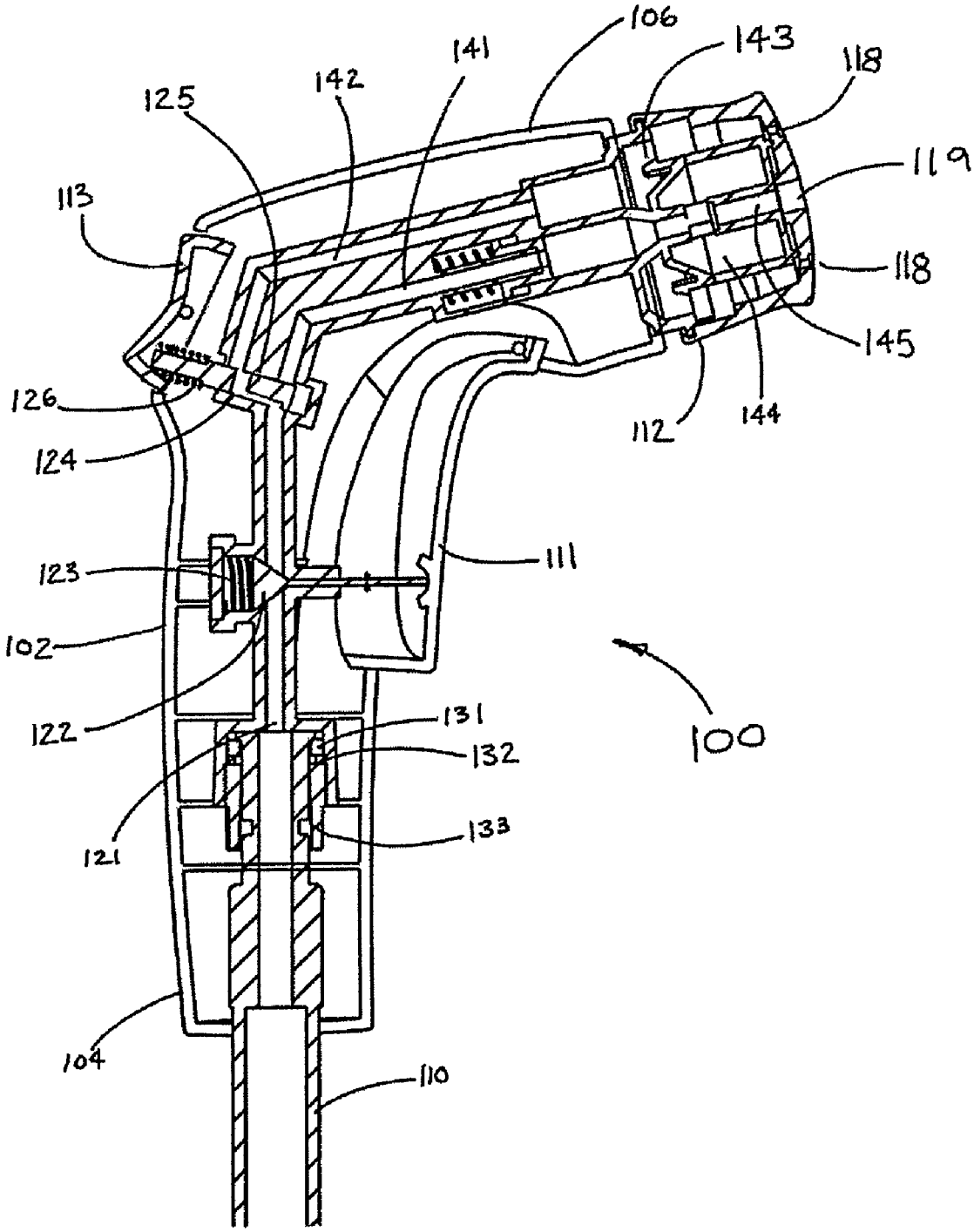
FIG. 8 is a cross sectioned side elevational view of the spray nozzle showing in FIG. 7 showing the toggle valve in the water dispensing position.

In this fourth embodiment, the outlet end 106 includes a threaded portion (not shown) disposed opposite the body 102 and adapted to releasably receive a cartridge 112. The cartridge 112 includes a clean water portion flow channel 143 and a chemical, or soap, dispensing flow channel 145 each of which communicates with a number of orifices 118, 119, respectively, located on the cartridge 112 opposite the outlet end 106. The cartridge 112 includes a chemical reservoir 144 that is functionally adapted to hold an amount of chemical, such as a cleaning soap or detergent, within it. When the cartridge 112 is engaged with the body 102, the trigger 111 can be depressed to allow water to flow through the body 102 and out of the cartridge 112. In this fashion, and with the toggle 113 in one position, as shown in FIG. 8, clean water simply flows from the nozzle 100. With the toggle 113 in another position, as shown in FIG. 7, however, the water becomes a water and chemical solution that is mixed within the nozzle 100 and dispensed by it as such is desired or required.

While the above description discloses the best modes of practicing the present invention, other alternative embodiments are also contemplated as being within the scope of the above invention. For example, the outlet end on each nozzle can be formed to have separate sets of orifices for dispensing clean water and water including an amount of the chemical dispensed with the water. This will enable the clean water orifices not to be contaminated by the chemical such that highly pure water can be dispensed from the nozzle when desired. Furthermore, in each of the embodiments the cartridge can be formed of a translucent material such that an operator of the nozzle can easily see whether the cartridge is empty or close to empty of the chemical, such that the cartridge needs to be replaced. Also, the attachments structures on the cartridges to secure the cartridges to the respective nozzle bodies can be varied as necessary in order to provide an easy and quick connection between the respective parts of the nozzle. For example, the connection can be a threaded connection, as described above, or a snap-in connection, a strap connection, and the like. Furthermore, in the embodiment of FIG. 1 when the cartridge 28 is positioned directly on the nozzle body, the cartridge 28 can be enclosed by a cover (not shown) pivotally or hingedly connected to the body 12 such that the cartridge 28 is completely contained within the nozzle body 12.

Various other alternatives are contemplated as being within the scope of the following claims particularly pointing out and distinctly claiming the subject matter regarded as the invention.

The invention claimed is:

1. A cleaning spray nozzle which comprises:

a nozzle body including an inlet for receiving water;

a trigger valve operable to infinitely vary the flow of water through the water flow continuum from a fully open continuum to a fully closed continuum;

a toggle valve downstream of the trigger valve, the toggle valve being operable to direct flow between a clean water flow channel and a chemical dispensing flow channel;

an outlet for discharging either clean water from the clean water flow channel or clean water and a chemical from the chemical dispensing flow channel downstream of the toggle valve; and a cartridge releasably secured to a portion of the nozzle body, the cartridge containing a chemical therewithin, the cartridge having an outlet that permits the flow of the chemical into the chemical dispensing flow channel.

2. The spray nozzle of claim 1 wherein the cartridge is releasably attached at the inlet of the nozzle body.

3. The spray nozzle of claim 1 wherein the cartridge is releasably attached at the outlet of the nozzle body.

4. The spray nozzle of claim 1 wherein the cartridge is formed from a plastic material.

5. The spray nozzle of claim 1 wherein the cartridge is generally translucent such that the contents of the cartridge are visible to a user.

6. The spray nozzle of claim 1 wherein the cartridge is adapted to hold a chemical in liquid, solid, granule, or other form within the cartridge.

7. A spray nozzle for optionally dispensing an amount of a chemical into a water stream flowing from the spray nozzle comprising:

a nozzle body having an inlet end, an outlet end and a conduit therethrough;

a trigger valve disposed between the inlet end and the outlet end, the trigger valve being operable to control the flow of water between the inlet end and the outlet end;

a toggle valve, the toggle valve being operable to direct water to flow through a clean water flow channel or a chemical dispensing water flow channel and a chemical containing cartridge attached to the nozzle body, the cartridge being operable to dispense water into the chemical dispensing water flow channel.

8. The spray nozzle of claim 7 including means for permitting the adjustment of the chemical containing cartridge to control the amount of chemical to be dispensed.

9. The spray nozzle of claim 7 wherein the cartridge is releasably attached to the inlet end of the nozzle body.

10. The spray nozzle of claim 7 wherein the cartridge is releasably attached to the outlet end of the nozzle body.

11. The spray nozzle of claim 7 wherein the cartridge is configured within the spray nozzle and functionally disposed between the inlet and the outlet of the spray nozzle.

12. The spray nozzle of claim 7 wherein the cartridge is formed from a plastic material.

13. The spray nozzle of claim 7 wherein the cartridge is generally translucent such that the contents of the cartridge are visible to a user.

14. The spray nozzle of claim 7 wherein the cartridge is adapted to hold a chemical in liquid, solid, granule, powder, or other form within the cartridge.

* * * * *